United States Patent [19]

Evans

[11] 4,040,828

[45] Aug. 9, 1977

[54] MULTICOLOR IMAGING METHOD AND IMAGED MEMBER EMPLOYING COMBINATIONS OF TRANSPARENT TONER AND COLORANT

[75] Inventor: Paul F. Evans, Plano, Tex.

[73] Assignee: Xerox Corporation, Stamford, Conn.

[21] Appl. No.: 538,826

[22] Filed: Jan. 6, 1975

[51] Int. Cl.[2] ..... G03G 13/01; G03G 9/00; G03G 9/08

[52] U.S. Cl. ..... 96/1.2; 96/1.4; 96/13; 96/14; 252/62.1 R; 427/14; 427/24

[58] Field of Search ..... 96/1.2, 13, 14, 1.4; 252/62.1 L

[56] References Cited

U.S. PATENT DOCUMENTS

| | | | |
|---|---|---|---|
| 2,681,473 | 6/1954 | Carlson | 96/1.2 |
| 3,057,787 | 10/1962 | Sagura | 96/1.2 X |
| 3,458,310 | 7/1969 | Arneth et al. | 96/1.2 |
| 3,649,268 | 3/1972 | Chu et al. | 96/27 R |
| 3,654,865 | 4/1972 | Tamai | 252/62.1 L X |
| 3,677,766 | 7/1972 | Tamai et al. | 96/1 LY |
| 3,682,825 | 8/1972 | Tamai et al. | 252/62.1 |
| 3,692,523 | 9/1972 | Tamai et al. | 252/62.1 L X |
| 3,717,463 | 2/1973 | Bach et al. | 96/1.2 X |
| 3,718,593 | 2/1973 | Tamai | 252/62.1 |
| 3,754,907 | 8/1973 | Chapin | 96/1.2 X |
| 3,776,757 | 12/1973 | Eastman et al. | 96/1.2 X |
| 3,788,845 | 1/1974 | Osawa et al. | 96/1.2 X |
| 4,006,267 | 2/1977 | Kurz | 96/1.2 X |

FOREIGN PATENT DOCUMENTS

| | | | |
|---|---|---|---|
| 1,811,872 | 7/1969 | Germany | 96/1.2 |
| 43-29429 | 12/1968 | Japan | 96/1.2 |

OTHER PUBLICATIONS (Anonymously), "Electrographic Formation of Dye Images," No. 10931, *Research Disclosure,* May, 1973, pp. 80–84.

*Primary Examiner*—David Klein
*Assistant Examiner*—John R. Miller
*Attorney, Agent, or Firm*—James J. Ralabate; Richard A. Tomlin; George J. Cannon

[57] ABSTRACT

An imaging system is disclosed wherein unpigmented transparent xerographic toner images are used to make color and full color pictorial transparencies and selected hard copy according to specific toner-tacking methods.

25 Claims, 9 Drawing Figures

MULTICOLOR IMAGING METHOD AND IMAGED MEMBER EMPLOYING COMBINATIONS OF TRANSPARENT TONER AND COLORANT

BACKGROUND OF THE INVENTION

The invention herein described was made in the course of or under a contract with the United States Government.

This invention relates in general to imaging systems and specifically to a method of creating colored images from imagewise configurations of transparent unpigmented toner.

Image reproduction is a diverse technology encompassing many different techniques, some very unusual and some very common. The invention herein disclosed is not limited to any particular one of these techniques, but is more readily adaptable to xerography as described by Chester Carlson in U.S. Pat. No. 2,297,691 and the many patents and publications issued in recent years.

Xerography has become a well-known process for producing copies of printed matter, pictures, writings and other scenes. Typically, a xerographic copy comprises a powder image of pigmented resin, or toner, on a support base such as paper, plastic or the like. Depending upon the particular application, the support base will be transparent, translucent or opaque, and the toner image viewed by transmitted or reflected light.

Suitability of a xerographic copy is generally related to the density of the toner image. For instance, a black toner image on white paper must absorb sufficient light to be readable, similarly a xerographically produced transparency must be sufficiently dense to block light projected through it so that the image may be viewed on a projection screen or other imaging surface.

Also, although conventional xerographic process steps may be followed to give the toned image for use herein, toner images may be formed by a multitude of other techniques such as depositing toner through a stencil, for example, as described in U.S. Pat. No. 3,487,775, or as taught in Childress et al., U.S. Pat. No. 3,081,698.

The basic concept of adding particles to a tackified toner image is not new. The Carlson et al. U.S. Pat. No. 2,955,052 and the Walkup et al. U.S. Pat. No. 2,955,035, both teach that a tackified toner image may be dusted with particles such as glass, wood, metal, plastic or rubber to produce various raised imge surfaces. It should be noted that the toner disclosed in these patents is that which is well known in the art, and comprises thermoplastic doped with carbon particles.

Several other patents have been issued which teach processes similar to those of Carlson and Walkup, including tackifying and transferring to other surfaces; however, none teach or suggest the use of transparent unpigmented toner in an imaging system as claimed herein.

Furthermore, the use of transparent toner is not per se new; however, its use in the environment of the instant invention is not heretofore known. For example, in U.S. Pat. No. 3,317,317, transparent optically active toner is used to make negative transparencies. Other patents which employ transparent particles in an imaging process include U.S. Pat. No. 3,782,932 and 3,196,765.

SUMMARY OF THE INVENTION

It is therefore an object of this invention to provide a method of creating full color pictorial images.

It is another object of this inventin to provide a method of creating full color pictorial images from electrostatic latent images which have been toned with transparent unpigmented toner.

It is a further object of this invention to provide a method of creating full color pictorial transparencies suitable for projection.

It is still a further object of this invention to provide a method of subtractive color imaging to create multicolored images.

Another object of this invention is to provide a method of creating full color pictorial images which requires the use of only a single type of toner material.

Another object of this invention is to provide a method of creating full color pictorial images by a strip-out process.

The foregoing objects and others are accomplished in accordance with this invention by providing an imaging system wherein unpigmented transparent xerographic toner images on a suitable base are used to make full color transparencies and selected hard copy according to specific toner-tacking methods.

DESCRIPTION OF THE DRAWINGS

The advantages of this improved method for forming an image will become apparent upon consideration of the following disclosure of the invention, especially when taken in conjunction with the accompanying drawings wherein.

DESCRIPTION OF THE PREFERRED EMBODIMENTS

Figure 1:
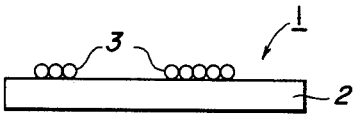
FIG. 1 is a cross-sectional, schematic view of an imaged member, showing the transparent unpigmented toner thereon in image configuration.

As will be explained in more detail below, in relation to FIGS. 5 and 6, the instant invention advantageously employs a color separation technique to produce images in multiple colors and full pictorial images.

To understand the color reproduction techniques of the instant invention, it is helpful to first understand color processing in general. Think of paper in terms of the reflection of light. A white paper reflects all colors falling on it and thus appears as white. If by coating the paper with ink so as to interfere with or absorb some portion of the light falling in it, it is possible to control the color of light reflection and thus be able to duplicate the appearance of an original piece of copy. It is this control that is afforded by marking materials. Marking materials on paper simply subtract from the amount of light falling on the paper.

White light is a mixture of all colors, but for practical purposes it may be considered as a combination of red, green and blue light. Each of the three colored printing colorants representative of these wavelengths absorbs one of the three components of the white light striking and reflects the other two. Black colorant is an absorber for all three components and thus reflects little or no light.

Cyan colorant absorbs the red part of white light. Where cyan is printed, only green and blue parts are reflected and the color appears to be cyan.

Magenta colorant absorbs the green part of white light. Magenta ink reflects only red and blue which appear to give areas covered by it a magenta color.

Yellow colorant absorbs the blue part of white light and where it is printed only the red and green parts are reflected. Red light added to green light gives the impression of yellow.

Black colorant absorbs all components of white light. Its main purpose in the printing processes are to increase density range and to stabilize the appearance of multicolor reproductions when register positions of the image are changed slightly during the printing process.

Cyan, magenta, and yellow colorants are thus called complementary of subtractive colors because they subtract or remove portions of the white light reflected from or traveling to the paper. By combining these colorants in various proportions and layers, it is possible to obtain the full spectrum of color, i.e., full color pictorial reproductions.

FIGS. 1–4 are used to illustrate the general technique of tackification and colorant transfer. The electrostatic latent image to which the toner is adhered is preferably created by the use of filters which block out all light from a colored original except that corresponding to a single color. The transparent unpigmented toner is then applied, tackified and colorant added thereto. A second filter is then used to create a second electrostatic image, corresponding to another color of the object which is toned, tackified, etc. These steps are repeated with different filters until the desired color make-up is obtained.

Any suitable means for providing color separation and corresponding electrostatic latent toned images may be used. The preferred mode is to use a panchromatic photoreceptor such as, for example, shown in U.S. Pat. No. 3,655,377, with filters for color separation as set forth above. Suitable separation may be accomplished with, for example, wratten gelatin filters available from Kodak. Also, it is possible to use multiple photoreceptors, each having a spectral response limited to only a portion, or portions of the colors contained in the original. By well known transfer techniques it would then be possible to sequentially transfer and add colorant to a single base member to create the colored image.

Referring now to the drawings in which like reference numbers refer to the same parts, FIG. 1 shows an imaged member 1 comprised of a substrate or base 2 having toner particles 3 thereon in imagewise configuration. The substrate 2 can be of any material, such as plastic, glass, paper, cardboard, etc., the only limitation being that it be capable of having a toner image created, or placed, thereon. Although the substrate 2 is, in this figure, illustrated as a thin layer of material, it is to be realized that the sheet may have substantial thickness and be in any form such as a web, a sheet, a cylinder, etc.

Toner particles 3 comprise a transparent unpigmented resin and can be any of the well known xerographic developers which either meet or can be modified to meet, the requirement of transparency. The descriptor "transparent" is intended to encompass those materials which transmit light rays therethrough without a high amount of scattering. These materials are optically transparent, at least in the thicknesses used, inasmuch as they permit images to be seen therethrough. They are not necessarily clear, but may be of various color tints, occurring either naturally or through drying, so long as the coloring does not interfere with the imaging process.

Figure 2:
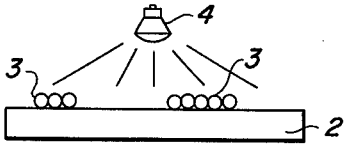
FIG. 2 is a partially cross-sectional, schematic view of the imaged member of FIG. 1 showing heat being applied thereto for tackification.

Reference is now had to FIG. 2 wherein tackification of the developed image on a substrate is illustrated. Infrared heating lamp 4 is positioned sufficiently close to the image particles 3 to affect tackification thereof onto substrate 2.

Tackification of a dry image is accomplished when the powder image becomes more adhesive. Although it is not intended to limit this invention to a particular mode of operation, it is now though that heat will act on the image particles to cause the viscosities and surface tensions of the image materials to decrease, thereby allowing the particles to either become softened or to flow together in a more liquefied adhesive single image body.

Although heat tackification is illustrated in this figure, it is to be realized that vapor tackification, or the like, as is generally known in the art may also be used and is intended to be included herein. The use of a proper solvent vapor for the image material will similarly cause the viscosities and surface tensions of the materials comprising the image particles to decrease and thus bring about the desired degree of tackification. An exemplary list of suitable solvents is set forth in U.S. Pat. No. 3,196,765. It should also be understood that the means of heating shown in this figure is not intended to be a limitation on the invention. Any suitable heating means may be used.

Substrate 2 should be composed of a material which is not made tacky during the image tackification step. When heat is used for tackification, the tackifier is adjusted to the proper temperature range for the xerographic developer materials. This temperature range will generally not affect paper and similar sheet material. If a plastic material is being used as substrate 2, it is desirable to choose a plastic material which is not affected by heat in the temperature range generally used for tackification of the image material to thereby avoid softening of the plastic material or to choose an image material which softens at a lower temperature. It is also to be realized that some substrate materials are softened by heat more readily than by vapors. In such an instance, it may be desirable to use vapor tackification rather than heat tackification. The preferred heating range is generally between about 30° C and about 200° C. the upper limit confined only by the destruction of the substrate and/or the image and the tackification of the substrate.

Several preferred modes of applying colorant require that the toner 3 be either fused or adhered to the substrate 2 sufficiently to prevent them from falling or being pushed thereoff. It is possible, however, to place the colorant, shown as colored particles 6, on a loose tackified toner image to create a useful end product.

Furthermore, as stated above, it is to be noted that tackification can be accomplished before, during or after transfer of the colorant. The time relationship between tackification and development depends upon the persistence of tackification of the toner. Materials which exhibit persistence are preferably used in embodiments which require tackification before development, while materials with little or no persistence may be preferred for simultaneous development and tackification. Also, it is sometimes desirable to include unpigmented anticaking additives in the transparent toner to allow the materials to flow better. For example, small amounts of fumed silicas such as "Cab-O-Sil" and "Silanox-101" available from Cabot Corporation, Boston and "Aerosil" available from Degussa, Inc. of Kearney, N.J. improve the flow characteristics of some toners.

After tackifying the transparent unpigmented toner image of FIG. 2, colorant is added thereto. The colorant 6 can be in any physical form, such as flakes, spheres, a fractured layer, etc., and is comprised of a pigment or other color producing material. Material 6 can be a mixture of physical forms and pigments; however, in the preferred modes for multiple colored images, each application would be a single color as pure as possible.

Figure 3:
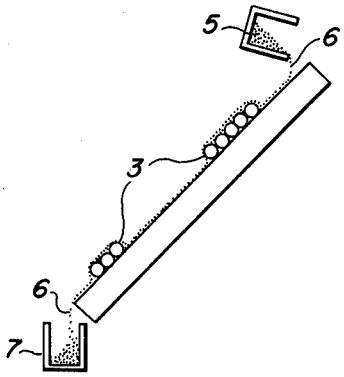
FIG. 3 is a partially schematic, cross-sectional view of one mode of developing the tackified imaged member of FIG. 2.

FIG. 3 shows one method of applying the particular colorant 6 to the tackified image of FIG. 2. Supply container 5 is used to sprinkle particles 6 across inclined member 2 whereby the particles adhere to the tackified toner 3. Excess particles are received in reservioir 7.

Figure 4:
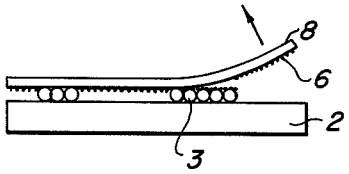
FIG. 4 is a partially schematic, cross-sectional view of the tackified imaged member of FIG. 2 having particles applied thereto from a donor member.

Another method of applying particles is shown in FIG. 4. The tackified toner image is contacted by a donor member 8 having a substantially uniform layer of particles 6 loosely held thereon. The layer of particles is brought into contact with the tackified image and split away therefrom to leave an imagewise layer of particles on the toner 3.

Any suitable method for applying particles to the tackified image may be used which does not materially disturb the image of transparent unpigmented particles. For instance, cascade, powder cloud, magnetic brush, etc. techniques will provide suitable results.

The use of transparent unpigmented toner to create the image is very advantageous for a number of reasons. A much broader class of materials is suitable for transparent toner images than for pigment-doped toner in images. More specifically, to produce useful pigmented xerographic toners it is necessary to match the pigment with the resin to produce a balance between color and electromechanical characteristics. Additionally, and importantly, a toner which has been doped with black pigment (or any other color) will not readily be masked by another colorant sufficiently to produce a sharp image.

By using an unpigmented toner in a xerographic process and adding colorant later, it is possible to use materials which may not normally be acceptable. For instance, some pigments excessively scratch or otherwise damage the photoreceptor while others display triboelectric characteristics either alone or in combination with resins which will not function within the xerographic system.

The instant invention offers a further important advantage in that it provides for the creation of color images while requiring only a single kind or type of toner. Such a system virtually eliminated or greatly minimizes triboelectric and other toner handling problems concomitant with multiple pigment toner systems.

It is also important to note that normal xerographic toner must be doped with black pigment to provide the necessary contrast. The more pigment that is added, the less tacky the toner can be made. Therefore, transparent unpigmented toner can be more receptive to the addition of colorant when in the tackified condition.

Color transparencies can also be made according to the instant invention. If substrate 2 is originally a transparent sheet, the remaining steps of the process would provide such a transparency. In the alternative, transparencies can be made by using any substrate with transparent unpigmented toner in image configuration, tackifying it, transferring colorant thereto, contacting with a transparent sheet, heating the colored toner and stripping the transparent sheet away. Part of the colorant would transfer to this sheet to create a color transparency.

Figure 5:
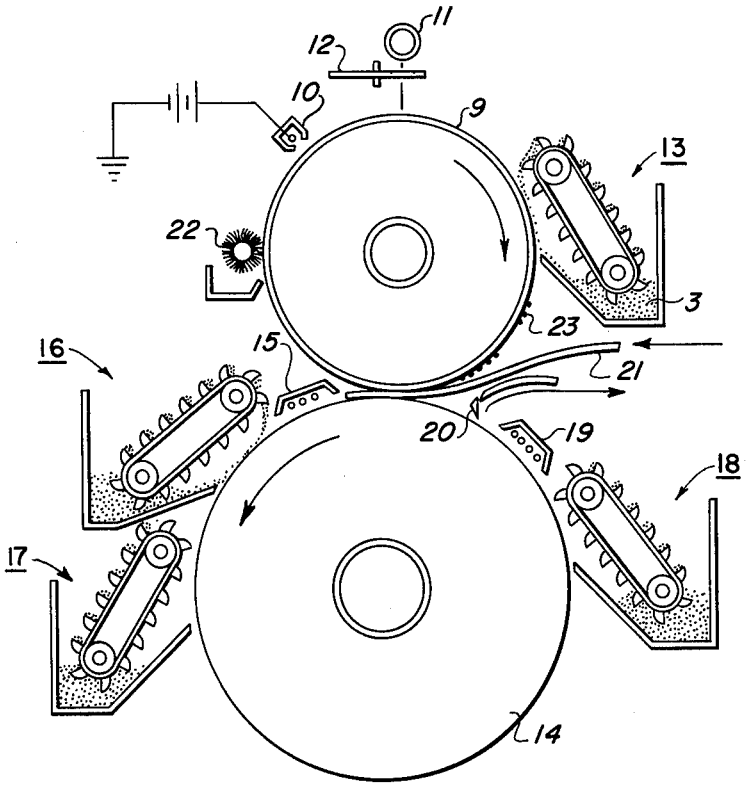
FIG. 5 is a partially schematic, cross-sectional view of a xerographic copier useful for creating imaged members such as shown in FIG. 1 and adding pigments thereto.

FIG. 5 shows exemplary apparatus for performing a preferred method of full color pictorial reproduction. Panchromatic photoreceptor 9 rotates about its axis to sequentially subject its active surface to the various operating stations. A substantially uniform electrostatic charge is applied to the surface by corona discharge device 10, and then imagewise exposed to 11. Filter device 12 is positioned between exposure means 11 and the surface of the photoreceptor to selectively separate the colors presented by the original. Device 12 can take any suitable structural configuration, such as a rotatable disk having separation filters thereon for rotation and alignment with exposure means 11. In conventional manner, transparent unpigmented toner particles 3 are cascaded onto the electrostatic latent image and adhere thereto at development station 13. Residual particles are removed from the photoreceptor by cleaning means 22, shown as a rotating brush.

As the image 23 on photoreceptor 9 advances past station 13, a receiver sheet 21 is fed onto drum 14. By conventional techniques, image 23 is transferred to sheet 21. After this transfer, the drum 9 is cleaned as by brush 22. The unpigmented tranparent particles which make up image 23 are then tackified by heater 15 and colorant in the form of particles, added thereto at standard cascade development station 16. The process is then repeated for each of the primary colors, receiver sheet 21 being in proper timing with photoreceptor rotation for image registration. Each development station 16, 17, and 18 contain a different colorant. After each of these steps, heater 19 fuses the color image to the receiver sheet 21. Finally, after each of the colorants have been added and fused, picker 20 is activated to remove the receiving sheet from drum 14.

It should be noted that an additional development station can be added to the periphery of drum 14 for the inclusion of black colorant if such is desired.

The system shown in FIG. 5 is merely exemplary of apparatus suitable for employing the concepts of the instant invention. Any suitable photoreceptor(s) may be used, as well as any suitable techniques for development, transfer, adding colorant and tackifying.

Figure 6A:
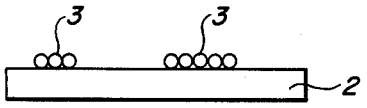
FIGS. 6A–6D are partially schematic, cross-sectional views of the steps necessary in the strip-out development scheme encompassed by the instant invention.
Figure 6B:
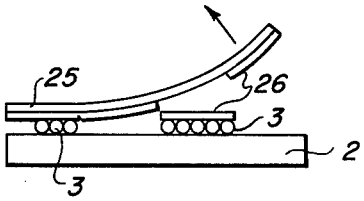

A further preferred embodiment of the instant invention which produces extremely good resolution can be seen in FIGS. 6A–6D. A substrate 2 has thereon, in image configuration, transparent, unpigmented toner material 3 which has been tackified as the member shown in FIG. 2. A colorant is applied to the tackified image in a strip-out process from a donor member as shown in FIG. 6B. The donor member itself is comprised of a carrier or support layer 25, which may be flexible, and a donor layer 26. The basic physical property desired in the donor layer is that it be frangible as prepared or after having been suitably activated. That is, the layer must be sufficiently weak structurally so that the application of the adhesive force exerted by the tackified toner particles will fracture the layer in image configuration. Of course, the donor layer is used for its color and is therefore selected with this in mind. Suitable fracturable donor members abound in the art, for example, those layers suitable for manifold imaging, as taught in U.S. Pat. Nos. 3,598,581 and 3,707,368 will produce satisfactory results. Also, "KO-REC-TYPE" sold and manufactured by Eaton Allen Corp. If Brooklyn, New York, in various colors and IBM's Film Ribbons for typewriters produce very satisfactory results when employed as taught herein. Any suitable frangible material or member may be used.

Figure 6C:
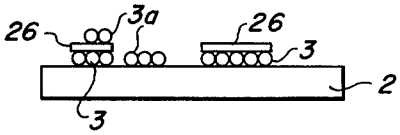

After a layer of colorant has been applied to the first image configuration, a second image configuration of particles, shown in FIG. 6C as toner 3*a*, is formed and tackified. Then, a second donor member, or a second colorant, is applied to the member and adheres to the second image configuration of particles.

Figure 6D:
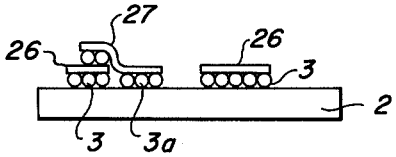

Note in FIG. 6D that the second layer of donor material 27 is shown to partially overlap the first. This overlap portion provides the color changes referred to above in the discussion of subtractive color systems. The steps may be repeated with additional donor members to achieve even further color in the final image. This overlap of additional layers of donor materials requires that previously deposited materials and layers exhibit positional and thermal stability during subsequent strip-out steps. In other words, for example, donor material 26 should not become sufficiently adhesive during the tackification step to cause donor material 27 to adhere to thereto. Nor should the toner particles 3 be made sufficiently fluid during the tackification steps to move about and thereby alter the image.

A further aspect of the invention includes the removal of the unpigmented transparent toner after the image particles have been transferred thereto, thereby creating an image comprised of colorant 6 alone. This desirable result can be obtained, as taught in U.S. pat. No. 3,615,394, the entire disclosure of which is hereby expressly incorporated herein by reference, by exposing the resin image to a solvent for the resin resulting in the resinous portion of the toner being dissolved away leaving only the colorant in imagewise configuration on the substrate. This technique is useful when the resinous portion of the toner would interfere with processes to be performed upon the image.

Although specific components proportions and process steps have been stated in the above description of preferred embodiments of the invention, other suitable materials, proportions and process steps, as listed herein, may be used with satisfactory results and varying degrees of quality. In addition, other materials which exist presently or may be discovered may be added to materials used herein to synergize, enhance and otherwise modify their properties.

Note, for example, that it is possible to use different transparent toners for the successive process steps to achieve different results. For example, greater color stability results from the use of toners with different melting temperatures. If the first toner exhibits the highest melting temperature, the next application and tackification step will not affect the first, thus eliminating color running and loss of resolution.

Furthermore, the above discussion centers mainly around the creation of the original transparent toner image by electrostatics; however, the invention is not so limited. Any means for creating the image may be employed, as for example, offset printing or by hand.

It will be understood that various changes in the details, materials, steps and arrangements of parts which have been described and illustrated in order to explain the nature of the invention, will occur to, and may be made by those skilled in the art upon a reading of the disclosure within the principles and scope of the invention.

What is claimed is:

1. A method for the reproduction of a multicolored original, comprising:

a. forming a first pattern of dry transparent unpigmented toner by developing with said toner a first electrostatic latent image of a first color in said original, transferring said first pattern of said toner to a base member, tackifying said first pattern of said toner, and applying a layer of a first colorant upon said first pattern of said toner; and b. forming at least a second pattern of dry transparent unpigmented toner by developing a second electrostatic latent image of a second color in said original, transferring said second pattern of said toner to said base member in a position relative to said first pattern which corresponds to the relative positioning of said first and second colors of said original, tackifying said second pattern, and applying a layer of a second colorant upon said second pattern.

2. The method of claim 1 wherein one of said two colors is black.

3. The method of claim 1 wherein said first and second electrical latent images are provided by the steps of;

sequentially exposing said xerographic photoreceptor through one of two light filters, each of which transmit only one color of light.

4. The method of claim 3 wherein said base member is a panchromatic xerographic photoreceptor.

5. The method of claim 1 wherein the transparent unpigmented toner of step (a) is the same as that used in step b.

6. The method of claim 1 wherein the tackifying steps are accomplished by heating said toned images.

7. The method of claim 1 wherein the tackifying steps are accomplished by conacting said toned image with a solvent vapor.

8. The method of claim 1 wherein the tackifying steps are accomplished simultaneously with the transferring steps.

9. The method of claim 1 wherein said base member comprises a sheet of paper.

10. The method of claim 1 wherein said base member comprises a transparent sheet.

11. The method of claim 1 wherein the transparent unpigmented toner used in step (a) has a different tackification temperature than that used in step b.

12. The method of claim 1 wherein said colorants are particulate.

13. The method of claim 1 wherein said first and second colorant layers are applied by contacting the tackified patterns of said toner with a donor layer comprised of a fracturable colorant whereby, upon removal of the donor layer, the fracturable colorant remains upon the tackified patterns of said toner.

14. The method of claim 1 further including the formation of at least a third pattern of unpigmented toner having applied thereto a layer colorant by practicing the steps recited in subparagraphs (a) or (b).

15. The method of claim 14 wherein said layer of first, second and third colorants each comprise a different color selected from the group consisting of cyan, magenta, yellow and black.

16. An electrostatically imaged member comprising:

a. a support member;

b. a first layer of transparent unpigmented dry toner thereon in a first image configuration and fused to said support member;

c. a first colorant on said transparent unpigmented dry toner in said first image configuration;

d. a second layer of transparent unpigmented dry toner in a second image configuration at least partially coincident with said first image configuration and fused to said support member and the first image where in contact therewith; and e. a second colorant, differing from said first colorant, on said transparent unpigmented dry toner in said second image configuration.

17. The imaged member of claim 16 further including:

f. at least one additional layer of transparent unpigmented toner in at least one additional image configuration at least partially overlapping said first and/or second image configuration and fused to said support member and the first and/or second image where in contact therewith; and g. at least one additional colorant, different from said first and second colorants, on said transparent unpigmented toner in said at least one additional image configuration.

18. The imaged member of claim 16 wherein said support member comprises paper.

19. The imaged member of claim 16 wherein said support sheet is transparent.

20. The imaged member of claim 17 wherein said support member comprises paper.

21. The imaged member of claim 17 wherein said support sheet is transparent.

22. The imaged member of claim 16 wherein the transparent unpigmented toner of step (b) is the same as that of step (d).

23. The imaged member of claim 16 wherein the transparent unpigmented toner of step (b) is different than that of step (d).

24. The imaged member of claim 17 wherein the transparent unpigmented toner of steps (b), (d) and (f) are different from each other.

25. The imaged member of claim 17 wherein the transparent unpigmented toner of steps (b), (d) and (f) are the same.

* * * * *